US012492877B2

(12) United States Patent
Berkeypile et al.

(10) Patent No.: US 12,492,877 B2
(45) Date of Patent: Dec. 9, 2025

(54) SUPPRESSION DEVICE FOR ROTARY MACHINE GUN

(71) Applicant: Centre Firearms Co., Inc., Ridgewood, NY (US)

(72) Inventors: Michael Berkeypile, Ridgewood, NY (US); Richard Ryder Washburn, III, Ridgewood, NY (US)

(73) Assignee: Centre Firearms Co., Inc., Ridgewood, NY (US)

( * ) Notice: Subject to any disclaimer, the term of this patent is extended or adjusted under 35 U.S.C. 154(b) by 0 days.

(21) Appl. No.: 18/863,712

(22) PCT Filed: Apr. 19, 2024

(86) PCT No.: PCT/US2024/025439

§ 371 (c)(1),
(2) Date: Nov. 7, 2024

(87) PCT Pub. No.: WO2024/226399

PCT Pub. Date: Oct. 31, 2024

(65) Prior Publication Data

US 2025/0277642 A1 Sep. 4, 2025

Related U.S. Application Data

(60) Provisional application No. 63/498,344, filed on Apr. 26, 2023.

(51) Int. Cl.
*F41A 21/30* (2006.01)
*F41A 21/06* (2006.01)

(52) U.S. Cl.
CPC ..... *F41A 21/30* (2013.01); *F41A 21/06* (2013.01)

(58) Field of Classification Search
CPC ..... F41A 21/06; F41A 21/30; F41A 21/32; F41A 21/325
See application file for complete search history.

(56) References Cited

U.S. PATENT DOCUMENTS 3,703,122 A * 11/1972 Farrington ..... F41A 21/32 89/14.3
3,705,529 A * 12/1972 Williams ..... F41A 21/08 89/14.2

(Continued)

FOREIGN PATENT DOCUMENTS

CN 113310346 A * 8/2021 ..... F41A 21/30
CN 113310346 B 2/2023
WO 2023064009 A1 4/2023

OTHER PUBLICATIONS

International Search Report and Written Opinion for PCT Application No. PCT/US2024/025439 dated Aug. 7, 2024, 13 pages.

*Primary Examiner* — Benjamin P Lee
(74) *Attorney, Agent, or Firm* — Duane Morris LLP

(57) ABSTRACT

A suppression device for a rotary machine gun includes a body; and a core configured to fit inside the body, wherein the core includes: a plurality of suppression tubes symmetrically oriented around the core with one each of the plurality of suppression tubes corresponding to one of a plurality of barrels of the rotary machine gun, and a redirector at a distal end of the core and including an angled surface to direct propellant gas emitted through a central channel of the core radially outward.

20 Claims, 10 Drawing Sheets

(56) References Cited

U.S. PATENT DOCUMENTS

| | | | | | |
|---|---|---|---|---|---|
| 3,898,910 | A * | 8/1975 | Groff | F41A 21/32 | 89/14.3 |
| 4,398,445 | A * | 8/1983 | Ulrich | F41A 21/08 | 89/14.3 |
| 4,574,682 | A * | 3/1986 | Hillman | F41A 21/32 | 89/14.3 |
| 4,656,919 | A * | 4/1987 | Farinacci | F41A 21/46 | 89/14.6 |
| 5,485,775 | A * | 1/1996 | Duke | F41A 21/32 | 89/14.3 |
| 5,583,313 | A * | 12/1996 | Austin | F41A 21/34 | 89/14.2 |
| 9,791,241 | B2 * | 10/2017 | Rowe | F41A 21/487 | |
| 11,604,042 | B1 * | 3/2023 | Paulson | F41A 21/48 | |
| 11,768,049 | B2 * | 9/2023 | Paulson | F41A 21/48 | 181/223 |
| 11,982,505 | B2 * | 5/2024 | Paulson | F41A 9/36 | |
| 2018/0051952 | A1 | 2/2018 | Rowe et al. | | |
| 2019/0186859 | A1 * | 6/2019 | Sautmann | F41A 21/30 | |
| 2021/0278160 | A1 | 9/2021 | Petersen | | |
| 2023/0251053 | A1 * | 8/2023 | Paulson | F41A 21/30 | 181/223 |
| 2025/0146779 | A1 * | 5/2025 | Paulson | F41A 21/06 | |
| 2025/0207882 | A1 * | 6/2025 | Alexander | F41A 21/06 | |

* cited by examiner

SUPPRESSION DEVICE FOR ROTARY MACHINE GUN

CROSS-REFERENCE TO RELATED APPLICATIONS

This application is a National Stage Application, filed under 35 U.S.C. 371, of International Patent Application No. PCT/US2024/025439, filed on Apr. 19, 2024, which claims the benefit of U.S. Provisional Patent Application No. 63/498,344 filed Apr. 26, 2023, the entireties of which are incorporated herein by reference.

FIELD OF THE INVENTION

The present invention relates to suppression devices, and more particularly, noise/flash/shock suppression devices that are used with a rotary machine gun.

BACKGROUND

Noise associated with the use of a firearm is, in general, attributed to two factors. The first factor is associated with the velocity of the bullet. If the bullet is traveling hypersonically (i.e., faster than the speed of sound), the bullet will pass through a slower moving sound wave preceding it, thus creating a relatively smaller sonic boom, similar to the sonic boom of a supersonic aircraft passing through its sound wave. The second factor is associated with the rapid expansion of propellant gas produced when the powder inside the bullet cartridge ignites. When the propellant gas rapidly expands and collides with cooler air, in and around the muzzle of the firearm, a loud bang sound occurs. The sound level of the muzzle blast is strongest in the direction the gun barrel is pointing, and decreases as the off-axis angle increases. Firearm noise suppression devices (hereafter "noise suppression devices") are employed to reduce noise attributable to the second factor identified above. Noise suppression devices have been in use at least since the late nineteenth century.

As mentioned above, noise suppression devices reduce the noise associated with the rapid expansion of propellant gas when the powder inside the bullet cartridge ignites and the propellant gas subsequently collides with cooler air in and around the muzzle of the firearm. In general, noise suppression devices reduce the noise by slowing the propellant gas, thus allowing the propellant gas to expand more gradually and cool before it collides with the air in and around the muzzle of the firearm. The process of allowing the propellant gas to expand more gradually and cool before it collides with the air in and around the muzzle of the firearm also reduces flash associated with firing a bullet.

Expanding propellant gas also creates a pressure or shock wave in the air emanating from the muzzle of the firearm. A spherical shock wave is centered on the gun's muzzle due to the explosive discharge of gases used to fire the bullet. In addition, the bullet also causes a shock wave as it travels supersonically out of the gun. A supersonic bullet causes a characteristic shock wave pattern as it moves through the air. The shock wave expands as a cone behind the bullet, with the wave front propagating outward at the speed of sound. This shock wave can be significant with rising bullet caliber. This shock wave can impact and affect others beside the shooter. In some situations, another person can be adjacent to the muzzle of the firing gun. For example, a vehicle driver or a helicopter pilot can be subjected to a shock wave from firing a mounted gun aimed forward. This situation can affect the driver, pilot's, or non-gunner's ability to concentrate or focus on their tasks. This situation can be exacerbated if the gun has a higher rate of fire such as a machine gun. A rotary machine gun, i.e., a minigun (e.g. M134 Minigun), features a Gatling-style rotating six-barrel assembly with an external power source providing an extremely high rate of fire (e.g. 2,000 to 6,000 rounds per minute). Sustained fire can subject an adjacent person to a sustained shock wave that can have both short and long term negative physical and cognitive health effects.

The present disclosure describes several features that address these concerns by reducing noise/flash/shock from firing a rotating machine gun.

SUMMARY

The present invention achieves its intended purpose through design features and manufacturing techniques that both individually and in conjunction with each other offer improvements over current, state-of-the-art suppression devices, especially for a rotary machine gun.

In an embodiment, a suppression device for a rotary machine gun includes a body; and a core configured to fit inside the body, wherein the core includes: a plurality of suppression tubes symmetrically oriented around the core with one each of the plurality of suppression tubes corresponding to one of a plurality of barrels of the rotary machine gun, and a redirector at a distal end of the core and including an angled surface to direct propellant gas emitted through a central channel of the core radially outward.

The suppression device can further include a gap between the body and the core.

In an aspect, the body includes threads to screw the suppression device onto the rotary machine gun.

In an aspect, the body includes a portion defined as a porous structure configured to permit gas to flow through.

In an aspect, the body includes a safety eyelet configured to accept a tether.

The suppression device can further include an end cap configured to secure the core in the body.

In an aspect, the central channel extends longitudinally through a central portion of the core.

In an aspect, each of the plurality of suppression tubes includes a bore extending therethrough and an inner opening between the bore and the central channel to permit propellant gas to flow from the bore to the central channel.

In an aspect, each of the plurality of suppression tubes includes an exhaust opening at a distal end to permit the propellant gas to exit the central channel.

In an aspect, the redirector reflects the propellant gas from the central channel to the exhaust openings.

In an embodiment, a suppression device for a rotary machine gun, includes a body; and a core configured to fit inside the body, wherein the core includes a plurality of suppression tubes symmetrically oriented around the core with one each of the plurality of suppression tubes corresponding to one of a plurality of barrels of the rotary machine gun, each of the plurality of suppression tubes includes a bore extending therethrough, and at least one of the plurality of suppression tubes includes an inner opening between its bore and a channel extending longitudinally through a central portion of the core to permit propellant gas to flow from the bore to the channel.

The suppression device can further include a redirector at a distal end of the core that includes an angled surface to direct the propellant gas emitted from the channel radially outward into the gap.

In an aspect, the body includes a portion defined as a porous structure configured to permit gas to flow through.

In an aspect, the core further includes a plurality of locating rings with each corresponding to one of the plurality of suppression tubes to aid alignment of the core with the plurality of barrels.

In an aspect, the at least one of the plurality of suppression tubes includes a plurality of inner openings between its bore and the channel.

In an embodiment, a suppression device for a rotary machine gun is configured to direct propellant gas from each barrel of the rotary machine gun into a corresponding suppression tube to a longitudinal central channel of a core and through an exhaust opening of the suppression tubes into a gap between the core and a body and out though the suppression tubes and a porous structure of the body.

In an aspect, each of the suppression tubes includes an exhaust opening at a distal end to permit the propellant gas to exit the central channel.

In an aspect, the core includes a redirector at a distal end of the core that includes an angled surface to direct the propellant gas emitted from the central channel into the gap.

In an aspect, each of the suppression tubes includes a bore extending therethrough and an inner opening between the bore and the central channel to permit propellant gas to flow from the bore to the central channel.

The above and other features, elements, characteristics, steps, and advantages of the present invention will become more apparent from the following detailed description of preferred embodiments of the present invention with reference to the attached drawings.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

It is to be understood that both the foregoing general description and the following detailed description are exemplary. The descriptions herein are not intended to limit the scope of the present invention. The scope of the present invention is governed by the scope of the appended claims.

Figure 1:
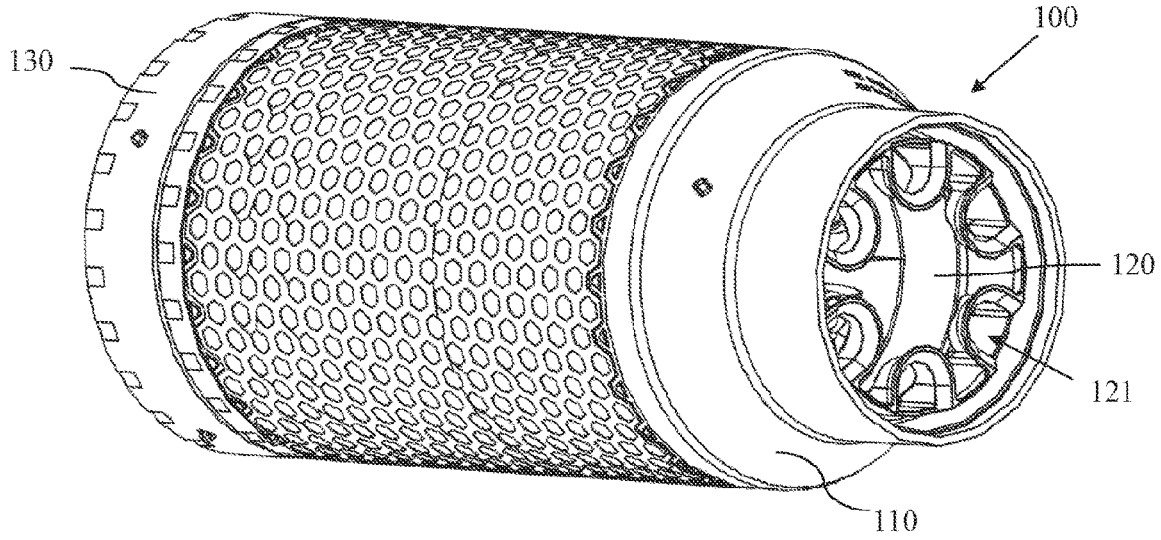
FIG. 1 and FIG. 2 are perspective views of a suppression device according to an embodiment of the present disclosure.
Figure 2:
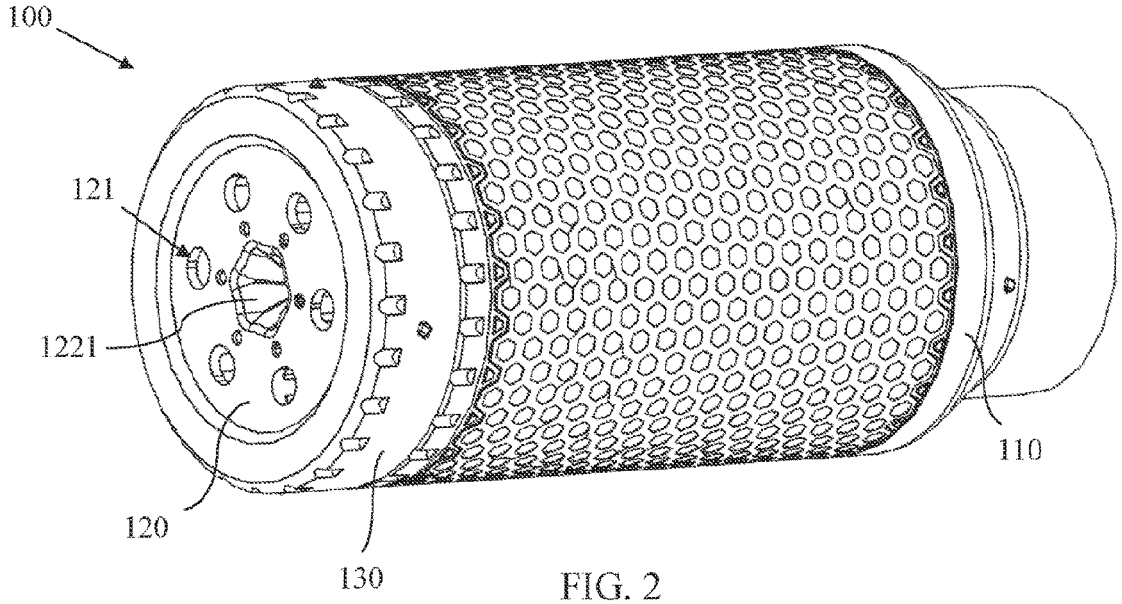
Figure 3:
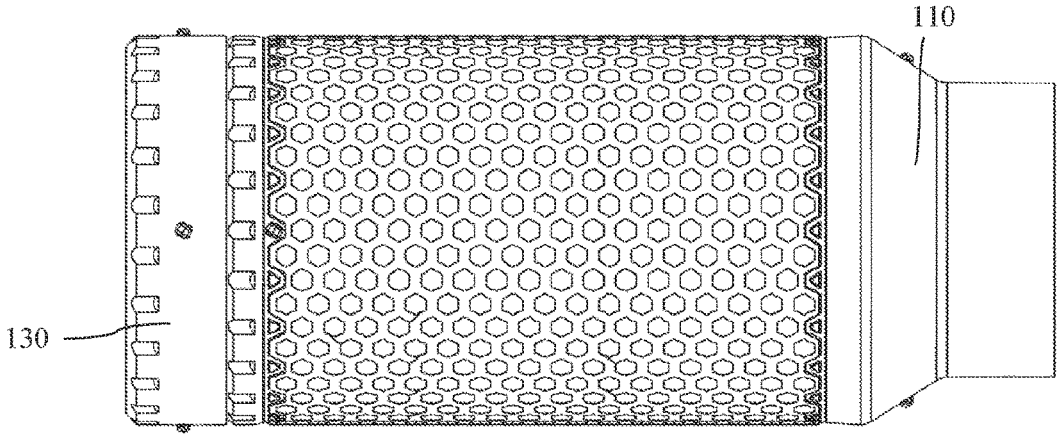
FIG. 3 is a side view of the suppression device.

FIGS. 1 and 2 are perspective views of a suppression device 100 according to an embodiment of the present disclosure. The suppression device 100 can include a body 110, a core 120, and an end cap 130. As shown, the suppression device 100 can include a plurality of suppression bores 121 with one each defined to match and fit with one of the plurality of barrels of a rotary machine gun, respectively. Although a suppression device configured for a rotary machine gun having six barrels is shown and described, a configuration for another number of barrels is possible. A proximal end of the core 120 shown in FIG. 1 can include one end of six suppression bores 121 symmetrically oriented around the core 120. Each suppression bore 121 is effectively a dedicated suppressor for its corresponding barrel. The core 120 can also include a redirector 1221, shown in FIG. 2, closing an end of a channel 122 (shown in FIG. 4) at a center of the core 120. FIG. 2 shows ends of the six suppression bores 121 and the redirector 1221 at a distal end of the core 120. FIG. 3 is a side view of the suppression device 100 showing the body 110 and the end cap 130.

Figure 4:
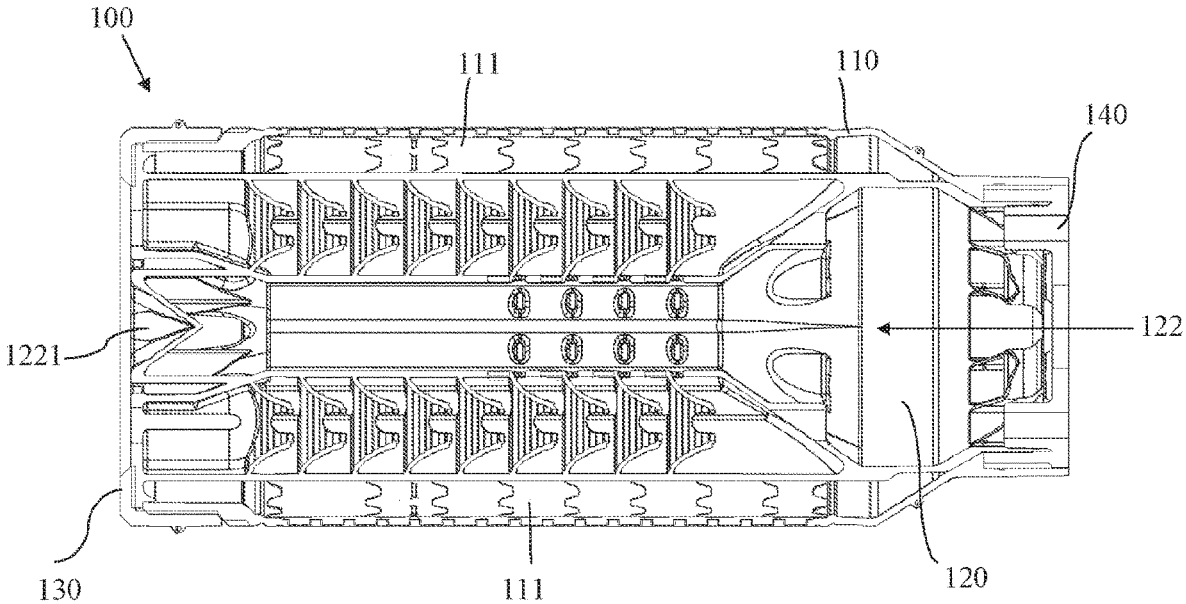
FIG. 4 is a side cross-section view of the suppression device.
Figure 5:
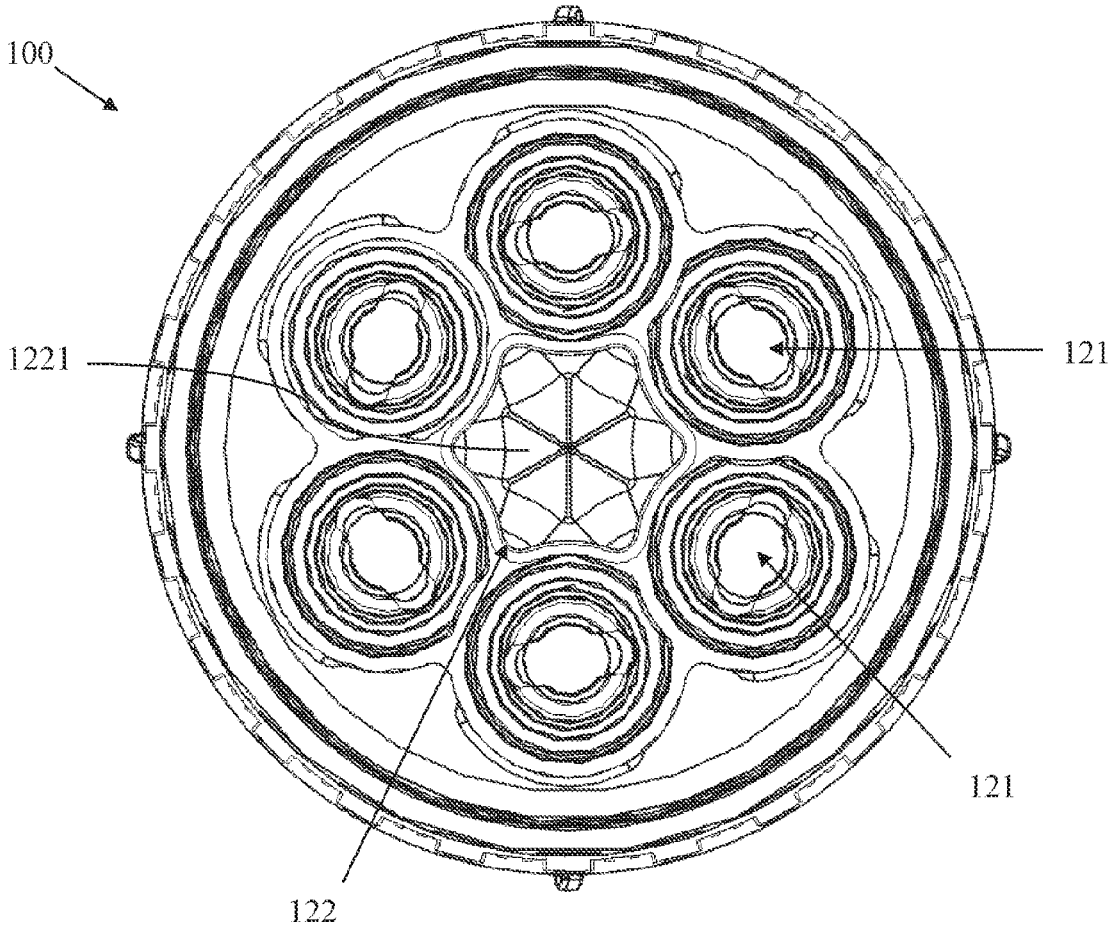
FIG. 5 is an end cross-section view of the suppression device.

FIG. 4 is side cross-section view of the suppression device 100 showing that there can be a gap 111 between the body 110 and the core 120 along a length of the body 110. This gap 111 can provide a space for propellant gases to enter and cool before exiting the suppression device 100. FIG. 5 is a Z-axis cross-section (i.e. end) view of the suppression device 100 showing the six suppression bores 121 and the redirector 1221.

Figure 6:
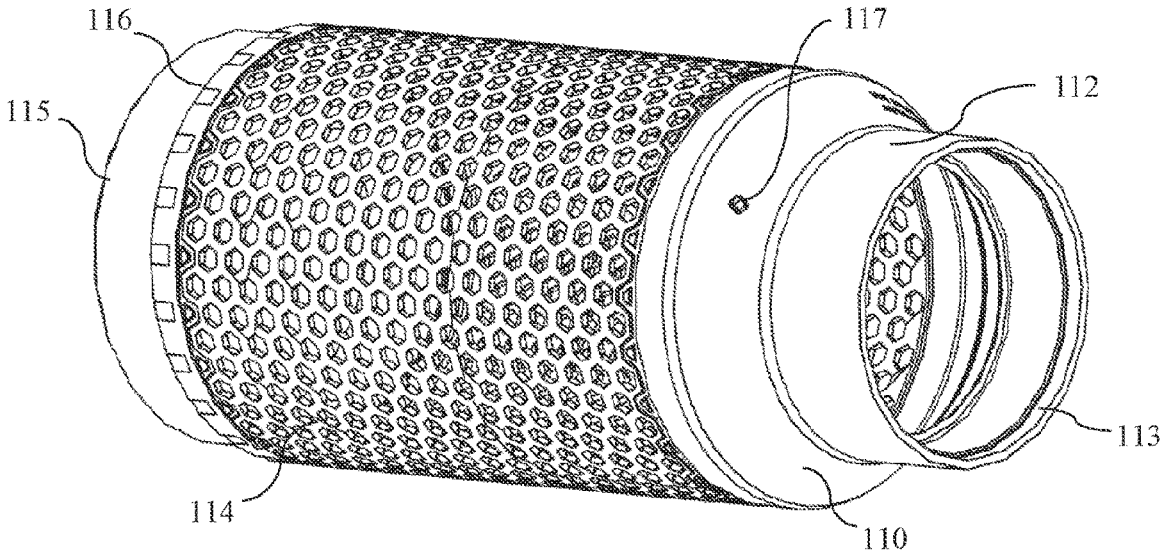
FIG. 6 and FIG. 7 are perspective views of a body of the suppression device.
Figure 7:
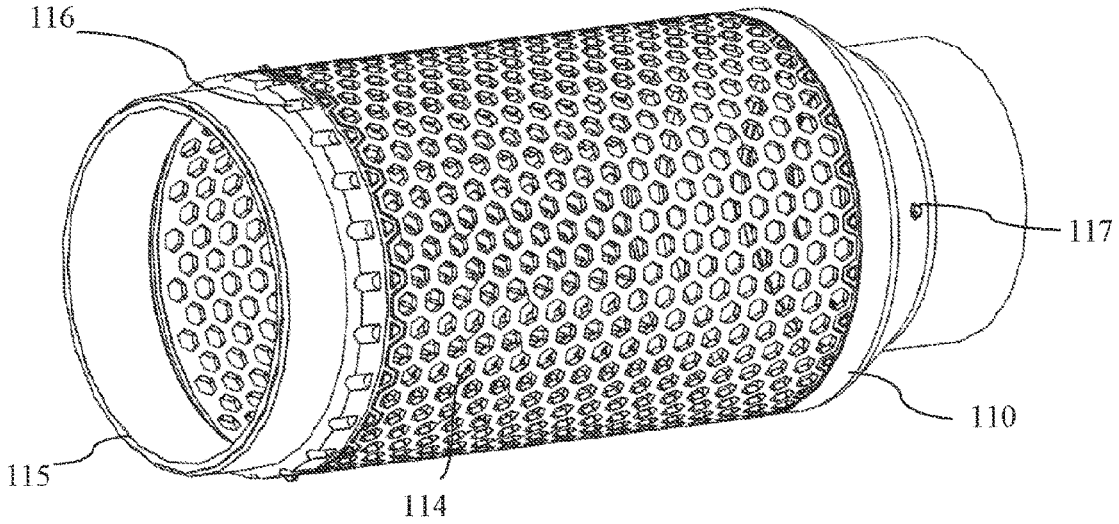

FIGS. 6 and 7 are perspective views of the body 110. These views show that the body 110 is substantially cylindrical and can include a proximal portion 112 that has a smaller diameter than the remaining portions of the body 110. The proximal portion 112 can include threads 113 used to screw the body 110 onto a shroud or barrel collar at the muzzle end of a rotary machine gun. Threads 113 can be included on either an inner or outer surface of the proximal portion 112. Because the shroud of the rotary machine gun rotates with the barrels during use, the threads 113 can be reverse threads so that the body 110 does not unscrew from the rotary machine gun during firing. The body 110 also includes a central portion 114 that can be defined as a mesh, lattice, honeycomb, or another porous structure to maximize material surface area while permitting gas to flow through.

The distal end 115 of the body 110 can include a series of grooves 116 defining a tooling spline. A tool such as a wrench or a spanner can be configured to include protrusions that fit into the series of grooves 116 such that the tool can fit over the distal end 115 and make contact with the series of grooves 116 to provide a way to grip and provide sufficient leverage while screwing the body 110 tightly to the shroud or another portion of the rotary machine gun. The leverage provided can meet a predetermined torque specification. The body 110 can also include a safety eyelet 117 for a safety tether. A chain, wire, or the like can be threaded through the safety eyelet 117 and secured at each end to provide a way to secure and eliminate the ability of the suppression device 100 to fly around uncontrollably if it becomes dislodged while in use or during movement or flight of the rotary machine gun while mounted to a vehicle, boat, or aircraft.

Figure 8:
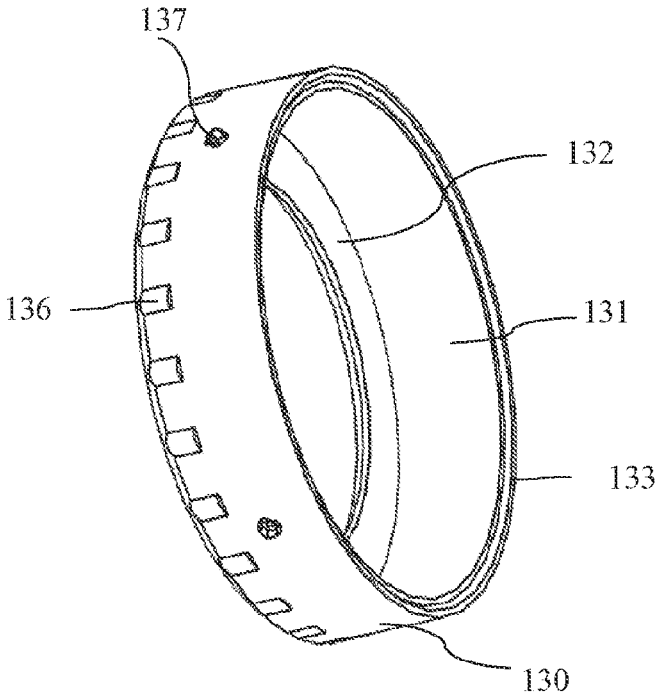
FIG. 8 and FIG. 9 are perspective views of an end cap of the suppression device.
Figure 9:
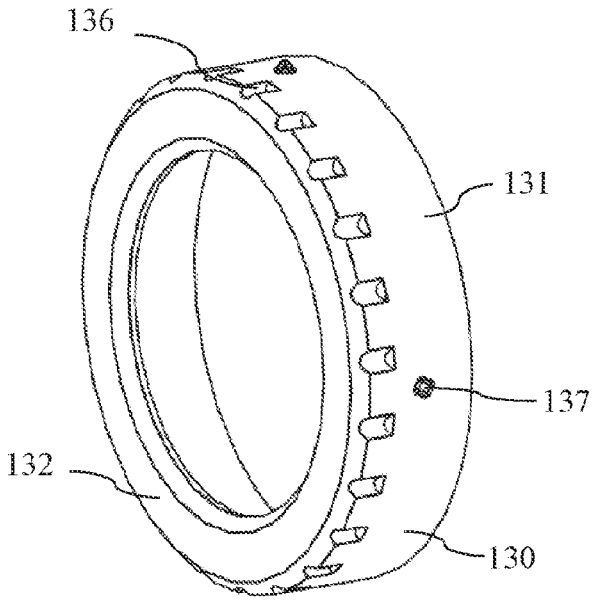

FIGS. 8 and 9 are perspective views of the end cap 130. The end cap 130 can include a substantially cylindrical body 131 that can include threads 133 used to screw the end cap 130 to the distal end 115 of the body 110. The end cap 130 provides a mechanism to retain or gain access to the core 120 in the body 110. The threads 133 can be reverse threads. A distal end of the end cap 130 can include a flange 132 used to narrow a through portion of the end cap 130 to retain the core 120 having a larger diameter in the body 110. The distal end of the end cap 130 can also include a series of grooves 136 defining a tool spine like that described above for the body 110. The end cap 130 can also include a safety eyelet 137 like that described above for the body 110.

Figure 10:
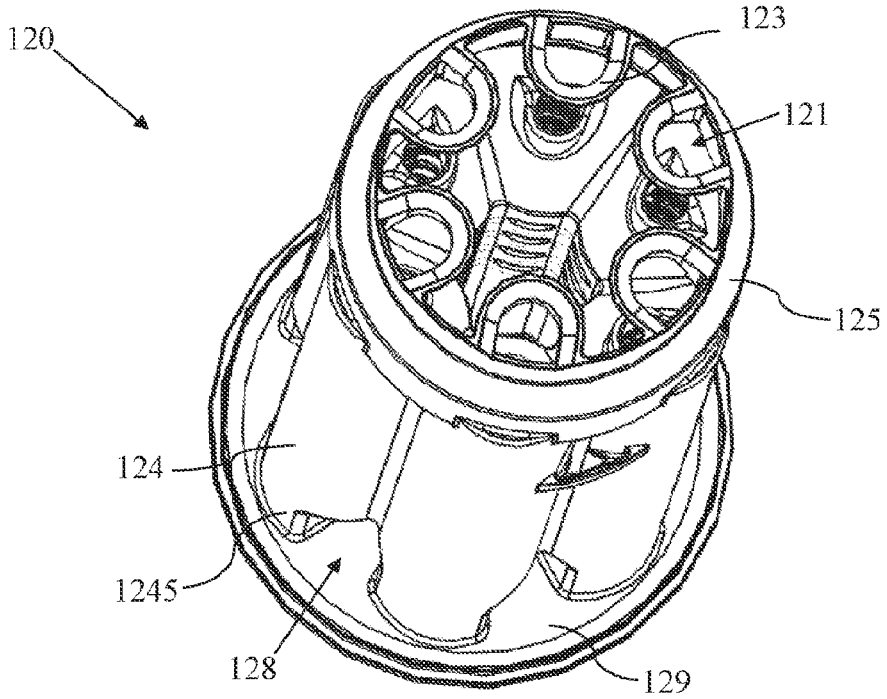
FIG. 10 and FIG. 11 are perspective views of a core of the suppression device.
Figure 11:
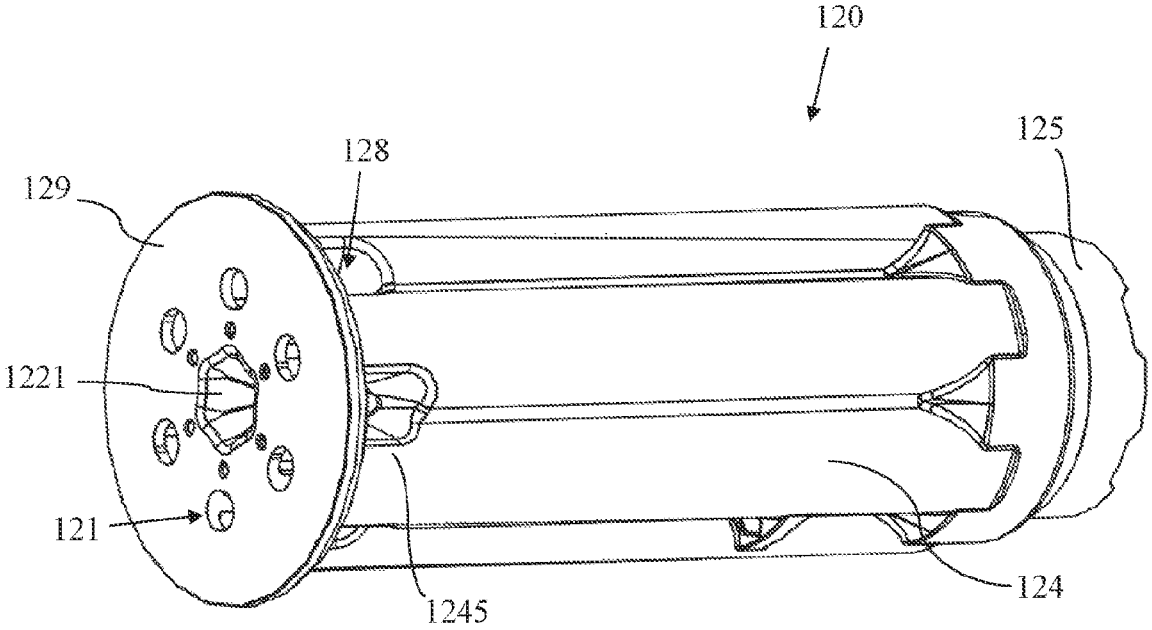
Figure 12:
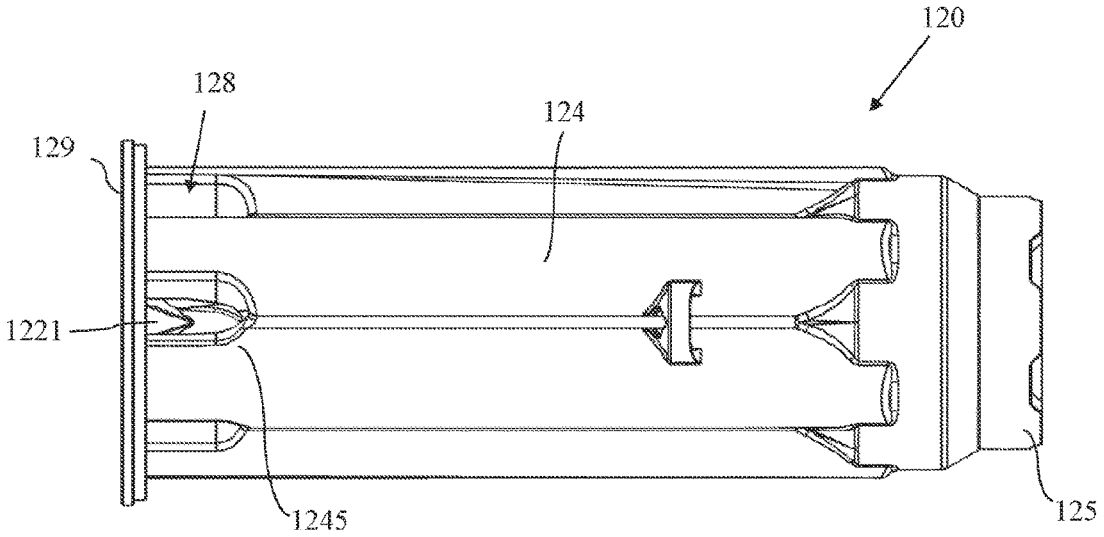
FIG. 12 is a side view of the core.
Figure 13:
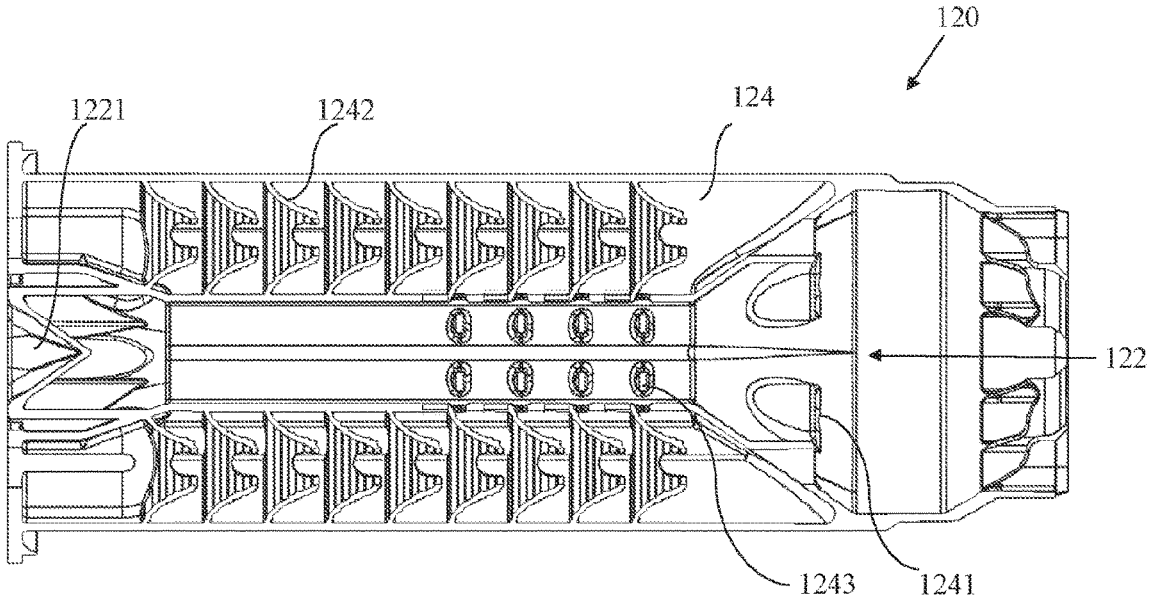
FIG. 13, FIG. 14, and FIG. 15 are cross-section views of the core.
Figure 14:
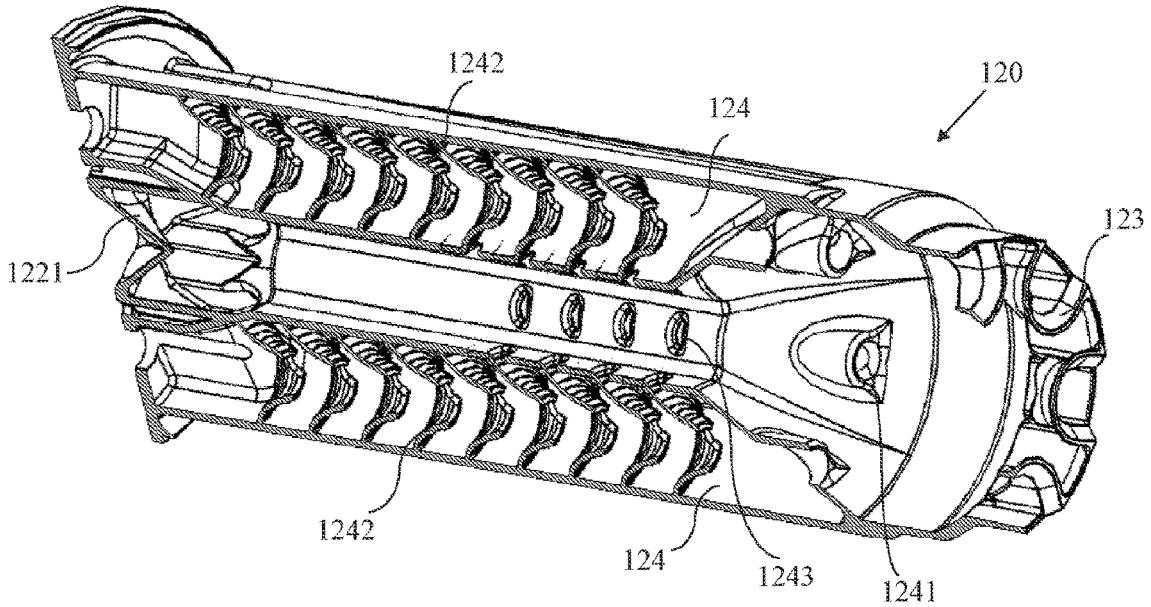
Figure 15:
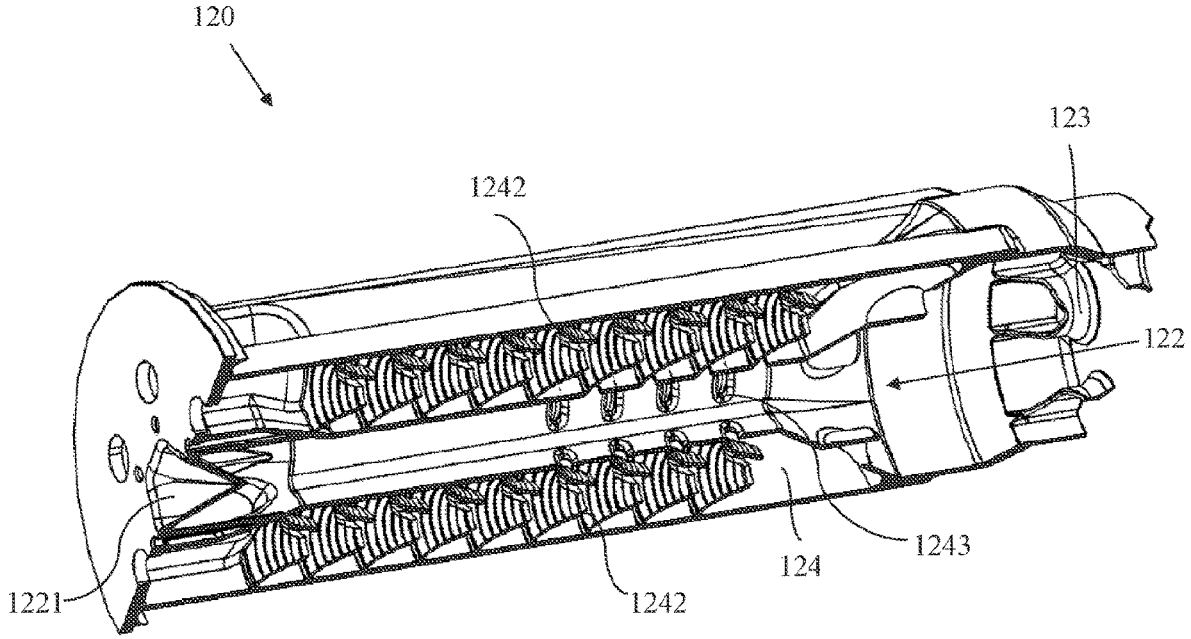

FIGS. 10 and 11 are perspective views of the core 120. FIG. 12 is a side view of the core 120. FIGS. 13-15 are cross-section views of the core 120. As shown, the core 120 can be substantially cylindrical to fit inside the body 110. Once the body 110 has been screwed onto a rotating machine gun, the core 120 can be inserted through the distal end 115 of the body 110 and aligned with the barrels of the rotary machine gun. After the core 120 is in place, the end cap 130 can be secured to the body 110 to retain the core 120.

The core 120 can include a collar 125 at the proximal end and a flange 129 at the distal end. The collar 125 can have a smaller diameter than a remainder of the core 120 and be configured to fit inside the proximal portion 112 of the body 110. The flange 129 is a portion of the core 120 that can have the largest diameter of the core 120. An outer diameter of the flange 129 can be greater than an inner diameter of the body 110 so that the flange 129 can define a hard stop that limits how far the core 120 can be inserted into the body 110. The flange 129 can include a stepped portion with different diameters so that one step fits inside the inner diameter of the body 110 and helps to center the core 120 within the body 110.

As mentioned above, the core 120 can include the plurality of suppression bores 121 and the channel 122 that extend through the core 120. Each suppression bore 121 can be aligned with a corresponding U-shaped or arched locating ring 123. The locating rings 123 are provided as aids to align the core with the plurality of barrels of the rotating machine gun. After the body 110 is mounted to the rotating machine gun, the core 120 can be inserted into the body 110 from the distal end 115. The core 120 is self-aligning in body 110 in that the core 120 will not fit fully into the body 110 without interference unless each of the locating rings 123 fits over the outside of one of the plurality of barrels. During assembly, the core 120 may need to be rotated slightly within the body 110 to align a locating ring 123 with a barrel before the core 120 can be fully inserted. The mechanical geometry is such that once the core 120 is fully inserted, each of the barrels of the rotating machine gun are aligned with one of the suppression bores 121.

Each suppression bore 121 extends through a corresponding tube 124. Each tube 124 effective provides suppression for one barrel of the rotating machine gun in combination with other features of the suppression device 100. The geometric arrangement of each of the tubes 124 can be the same, although not required.

As shown in the cross-section views of FIGS. 13-15, a tube 124 can include an inlet 1241, the inlet 1241 being an opening in which a suppression bore 121 extends through and a projectile shot from a barrel passes through into the tube 124. A tube 124 can also include at least one baffle 1242 to redirect and disrupt propellant gases. The at least one baffle 1242 can be substantially conical shaped. It is common to refer to a plurality of baffles as a baffle stack. It will be understood, however, that the present disclosure is not limited to a device having a certain number of baffles 1242.

A tube 124 can also include an inner opening 1243 to allow propellant gas to escape from the tube 124 into the channel 122 that extends through a center of the core 120. The exterior surfaces of the tubes 124 joined together at the central portion of the core 120 to create a space that defines the channel 122.

FIGS. 10-12 show that the tubes 124 can include a taper 1245 at the distal end. Combined together, the tapered portions 1245 of adjacent tubes 124 create an exhaust opening 128 that is a passage from which propellant gas in the channel 122 can exit the channel 122. The redirector 1221 can provide a surface that reflects the propellant gas from the channel 122 to the exhaust openings 128. As shown, the redirector 1221 can be a pyramid shape. Alternatively, the redirector 1221 can be conical shaped or any other suitable shape.

Figure 16:
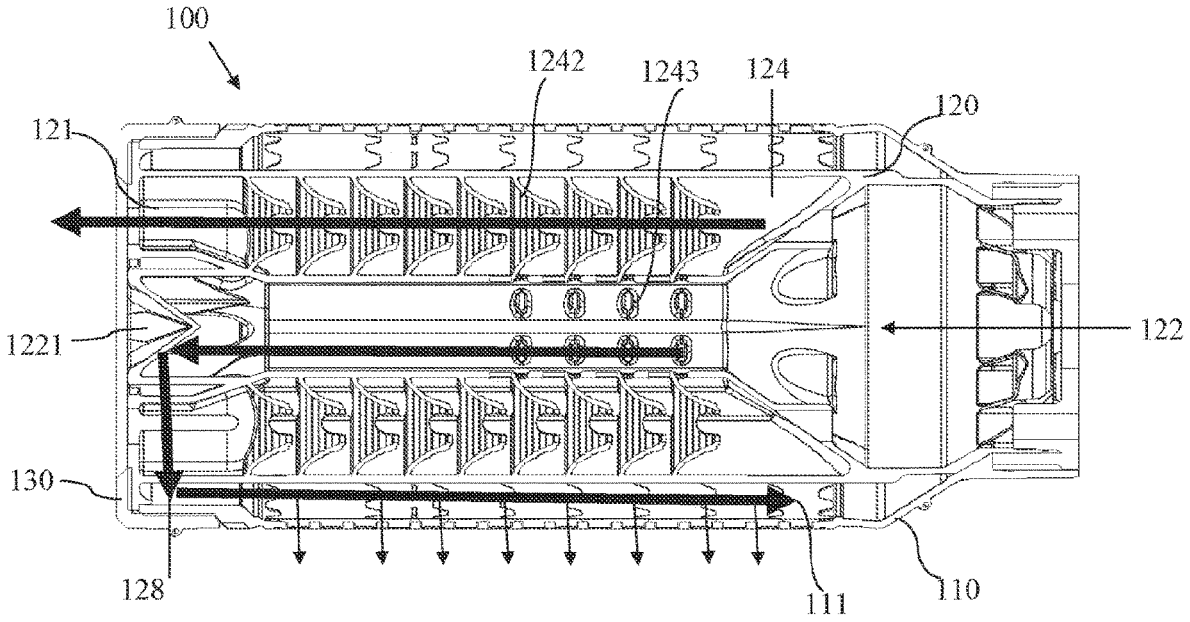
FIG. 16 is a cross-section view of the suppression device used to describe how the propellant gas is managed to accomplish noise/flash/pressure suppression.

FIG. 16 is a cross-section view of the suppression device 100 used to describe how the propellant gas is managed to accomplish noise/flash/pressure suppression. The bold black arrows represent flow paths of propellant gas. The top arrow pointing right to left represents flow of propellant gas through the tubes 124. This represents a direct path of propellant gas following a round shot through the suppression bores 121 of a tubes 124. Propellant gas will be slowed, disrupted, and cooled by the baffles 1242 as the propellant gas travels through the tube 124 and can exit the tube 124 via the distal end of the suppression bore 121.

Propellant gas can also exit a tube 124 via an inner opening 1243 as represented by the lower right-to-left arrow in FIG. 16. As shown, each tube 124 can include a plurality of inner openings 1243 being located as biased toward the proximal end of the tube 124. Propellant gas disrupted by baffles 1242 can exit an inner opening 1243 and enter the channel 122. Gas pressure forces the propellant gas toward an exit at an exhaust opening 128. The redirector 1221 provides a surface to reflect the propellant gas towards one of the exhaust openings 128 at about a right angle. The propellant gas can exit the exhaust opening 128 to the gap 111 between the housing 110 and the core 120 at about another right angle effectively moving the propellant gas in an opposite direction from which it originates. Propellant gas can exit the gap 111 to outside of the suppression device 100 via the openings in the lattice or mesh structure of the body 110. As a result, the propellant gas along this path is slowed, disrupted, and cooled as heat is absorbed from the gas by surface area of the suppression device 100.

Figure 17:
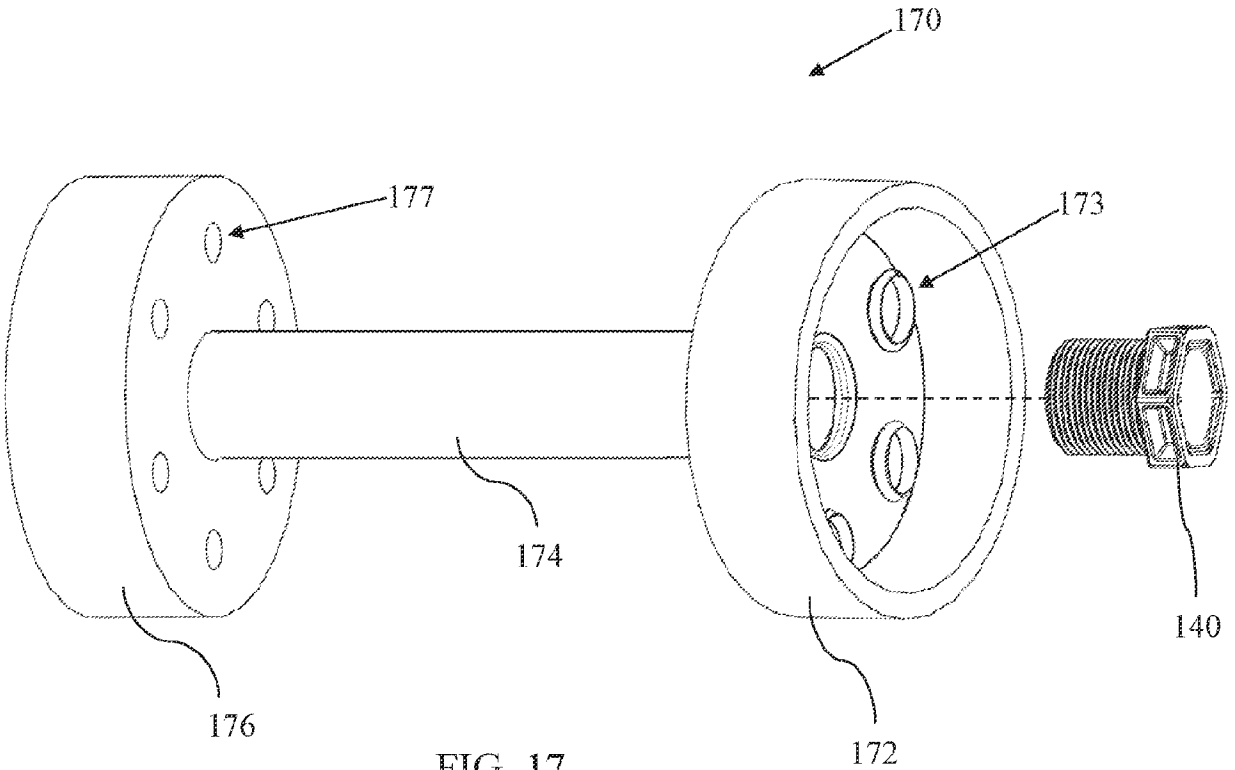
FIG. 17 is an exemplary view of a shroud for a rotary machine gun.

As previously mentioned, the suppression device 100 can be screwed to a shroud or barrel collar of the rotary machine gun. FIG. 17 illustrates such a shroud 170. As shown, the shroud 170 can include a proximal barrel collar 172, a distal barrel collar 176, and a hollow tube 174 secured to and connecting the proximal barrel collar 172 and the distal barrel collar 176. As assembled, the barrels of the rotary machine gun fit through respective holes 173, 177 in the proximal barrel collar 172 and the distal barrel collar 176 such that the shroud helps to set and secure the spacing and relative arrangement of the barrels. Because the tube 174 is hollow it can fill with propellant gas emitted into the suppression device 100. Thus, the tube 174 can assist in collecting and cooling propellant gas and contribute to suppression. Rather than directing propellant gas directly back to the gunner, the end of the tube 174, opposite to the location of the suppression device 100, can include a plug 140. For example, as shown, the plug 140 can screw into an end of the tube 174. In some embodiments, the plug 140 can be welded to or otherwise permanently attached to the tube 174 or proximal barrel collar 172.

In some embodiments, the plug 140 can be solid to seal the end of the tube 174 such that all propellant gas must exit through the suppression device 100. In some embodiments, the plug 140 can include one or a plurality of holes or ports (not shown). The size, number, and locations, of such holes can be varied to regulate the flow of propellant gas escaping through the plug 140. In some embodiments, a port in the plug 140 can be adjustable to allow more or less propellant gas to escape. In some embodiments, the plug 140 can include a portion having purposely induced porosity (PIP) (described in more detail below), to allow propellant gas to escape through the plug 140 with increased surface area.

In some embodiments, the tube 174 can include suppression features including but not limited to baffles, chambers, varying gas pathways, bleed holes, varying material density, PIP, and a lattice structure in various configurations to capture, slow down, disrupt, and cool propellant gas.

In accordance with the present disclosure, the body 110, the core, 120, the end cap 130, and the plug 140 can be individually manufactured as monolithic units. In accordance with an exemplary embodiment, any or all of these components can be manufactured using a layered printing process. Layered printing is a well known process for manufacturing three-dimensional objects from a digital model, whereby micro-thin layers of the manufacturing material are laid down successively until the entire three-dimensional object is complete, for example, by 3D printing.

Although the suppression device 100 includes several components and is not entirely monolithic, components are monolithic if there are at least no welded joints or seams between the various components that make up the body 110, the core 120, the end cap 130, and the plug 140. As stated, this can be accomplished using a layered printing process. As one skilled in the art will readily appreciate, the propellant gas exerts a great deal of pressure on the inner surfaces of any suppression device, and welded joints or seams are more likely to become points of mechanical failure than the corresponding, seamless points in components of the suppression device 100. Thus, as stated above, manufacturing these components as monolithic units enhance the overall structural integrity of the suppression device 100 that would otherwise include many more pieces. Individual components of the suppression device 100 can be made from plastic, metal, alloys, fiber, composite materials, or combinations thereof using a 3-D printing process. Further, the resulting monolithic units can be subject to secondary processing to subtract material to define certain features.

Components of the noise suppressor 100 including the body 110, the core 120, and the end cap 130 can be made with varying structural density and/or purposefully induced porosity. That is, the amount of bridging connections within the structure per volume and size of the holes or spaces between the bridging connections can change through the component. For example, the structure of components can be less dense in the proximal end and denser toward the distal end. One of ordinary skill in the art would appreciate that the density changes of the structure in the components need not be gradual in only one direction, but can be varied by design based on performance needs, material, caliber and parameters of the bullet, size of the suppression device, and other factors.

As previously discussed, noise/flash/pressure suppression is achieved through the cooling and slowing of the hot propellant gas that is generated when a round is fired from a gun. The cooling and slowing process can be achieved in multiple ways, primarily through heat transfer from the propellant gas to the core and the body of a suppression device, controlling the expansion of the gas, and disrupting the gas pathway to slow the propellant gas. Conventional suppression devices are limited in size and volume depending on the firearm caliber used because they are closed pressure vessels. By allowing the walls and/or internal structures to "breathe" by constructing a suppressor device with purposely induced porosity (PIP) providing material varying density, suppressor device design is not constrained in the same manner as conventional suppressors because pressures inside the suppressor device 100 are significantly reduced. This pressure reduction using PIP can be introduced into minute areas or expansive areas of a suppressor device, which are variable by design.

Purposely induced porosity is a feature of a suppressor device structure where porosity features of the material used to make the suppressor device are intentionally built into the suppressor device. Although it can be possible to construct a one-piece monolithic suppressor device with multiple materials, a single material or compound is more typical due to the manufacturing constraints and mechanical weaknesses generated at interfaces of different materials. Industry standards generally govern the determination of properties such as strength, density, heat capacity, and thermal conductivity of a given material. However, strength, density, heat capacity, and thermal conductivity of a suppressor device can be changed by altering the porosity, a fraction of the volume of pores per volume of mass, in the material of the noise suppressor.

Porosity of the suppressor device material can be changed by changing pore sizes or changing the number of pores (pore density) in a volume. The relationship of porosity, pore size, and pore density is such that as the porosity increases by increasing the size of the pores for a given volume, the density of the pores (number of pores per volume) can stay the same up to the point that the material can no longer support the pores without breaking down. At this point, the material walls of the pores must be thick enough to sustain the pores, and as the size of the pores continue to increase, the density or number of pores for the same volume has to decrease. That is, when the porosity is as close to 100% as possible, given some minimum material wall thickness that creates the pores, the pore density would be one (1) in that volume. The porosity and pore density can also be manipulated by changing the number of pores with different sizes.

Porosity, pore size, and pore density can be predetermined and built into a suppressor device by changing the design and parameters of 3D printing techniques such as, printing method, energy source type, energy source exposure, energy source power, gas flow, material, base material particle size, and material application. These parameters can be selected and programmed to affect meld pool geometry, material vapor flow, and ambient gas pressure to create desired gas pockets to generate desired porosity features. Furthermore, these parameters can be changed throughout the fabrication process to generate different porosity features at different portions of the suppressor device.

Providing the walls and internal structures of the suppressor device to be porous also provides far superior heat distribution versus a conventional suppressor made with the same material. The ability to essentially generate a desired porosity at any given area or a section of a suppressor device provides design flexibility to create areas with structures that have very small features with a high surface area, or very dense features with a low surface area. Altering the porosity and surface area for a given material will affect the amount of heat absorption that each particular area will have upon contact with the hot propellant gas exerted by each fired round. By fine-tuning each section of a suppressor device based on its wall thickness, porosity, and location in the suppressor device, heat distribution can be optimally balanced. Even heat distribution is a major improvement over the functionality of a conventional suppressor because it removes a major failure point of conventional suppressors where heat is disproportionally absorbed and retained most often in the blast baffle/expansion chamber area of the suppressor device closest to the barrel. Repeated overheating generates stress and fatigue that can lead to a catastrophic failure in the body of a suppressor due to material weakness.

Another major advantage of PIP is the reduction of blowback of the propellant gas toward the eyes and face of the shooter. In a conventional suppressor that is a solid pressure vessel with a fixed space volume until the bullet leaves the distal end, there is only a limited space that the propellant gas can occupy. This situation can lead to excess propellant gas being violently forced backwards through the action of the firearm, directly into the facial area of the shooter. Blowback of propellant gas is extremely detrimental to the proper continued use and aiming of the firearm, as the propellant gas's heat and chemical composition will cause burning and obscured vision. However, a suppressor device with PIP is not constrained to a fixed space volume because it is no longer a solid pressure vessel. Excess pressure and gas, while the space volume of the suppressor device is fixed, i.e., in the time frame in which the bullet is blocking the advancement of the propellant gas from escaping the suppressor device, are allowed to exit through pores created in the surfaces of the body of the suppressor device instead of back through the action of the firearm toward the shooter.

The ability to balance pressure and heat distribution in a suppressor device, is another advantage of PIP. By being able to define the porosity of the surfaces of the body of the suppressor device and internal structures independently to a desired degree, there are essentially unlimited possibilities in terms of how to design localized pressure and heat absorption in a suppressor device. For example, a design for the expansion chamber/blast baffle area could include an extremely porous wall of the expansion chamber area and a dense blast baffle, thus forcing all of the propellant gas immediately forward to exit out of the suppressor device. In another option, the wall of the expansion chamber area and the blast baffle can have a medium porosity, allowing some propellant gas to exit the suppressor device through the wall and also allowing some gas to continue its forward path into the further chambers and out of the suppressor device. In another option, the wall of the expansion chamber area can be made very dense and the blast baffle very porous, thus forcing all propellant gas forward towards the exit of the suppressor device while the internal features allow the gas alternate paths of escape. These examples only describe what is possible in the portion of the suppressor device closest to the barrel, and mixing and matching porosities can be provided in all areas of the suppressor device, allowing for extreme fine tuning. Additionally, porosity can be increased near the top distal end of the body of the suppressor device to vent propellant gas to mitigate recoil and achieve the benefits of compensation discussed above.

The present invention has been described in terms of exemplary embodiments. It will be understood that the certain modifications and variations of the various features described above with respect to these exemplary embodiments are possible without departing from the spirit of the invention.

What is claimed is:

1. A suppression device for a rotary machine gun, the suppression device comprising:

a body; and a core configured to fit inside the body, wherein the core includes:

a plurality of suppression tubes symmetrically oriented around the core with one each of the plurality of suppression tubes corresponding to one of a plurality of barrels of the rotary machine gun, and a redirector at a distal end of the core and including an angled surface to direct propellant gas emitted through a central channel of the core radially outward.

2. The suppression device of claim 1, further comprising a gap between the body and the core.

3. The suppression device of claim 1, wherein the body includes threads to screw the suppression device onto the rotary machine gun.

4. The suppression device of claim 1, wherein the body includes a portion defined as a porous structure configured to permit gas to flow through.

5. The suppression device of claim 1, wherein the body includes a safety eyelet configured to accept a tether.

6. The suppression device of claim 1, further comprising an end cap configured to secure the core in the body.

7. The suppression device of claim 1, wherein the central channel extends longitudinally through a central portion of the core.

8. The suppression device of claim 1, wherein each of the plurality of suppression tubes includes a bore extending therethrough and an inner opening between the bore and the central channel to permit propellant gas to flow from the bore to the central channel.

9. The suppression device of claim 7, wherein each of the plurality of suppression tubes includes an exhaust opening at a distal end to permit the propellant gas to exit the central channel.

10. The suppression device of claim 9, wherein the redirector reflects the propellant gas from the central channel to the exhaust openings.

11. A suppression device for a rotary machine gun, the suppression device comprising:

a body; and a core configured to fit inside the body, wherein the core includes a plurality of suppression tubes symmetrically oriented around the core with one each of the plurality of suppression tubes corresponding to one of a plurality of barrels of the rotary machine gun, each of the plurality of suppression tubes includes a bore extending therethrough, and at least one of the plurality of suppression tubes includes an inner opening between its bore and a channel extending longitudinally through a central portion of the core to permit propellant gas to flow from the bore to the channel.

12. The suppression device of claim 11, further comprising a gap between the body and the core.

13. The suppression device of claim 12, further comprising a redirector at a distal end of the core that includes an angled surface to direct the propellant gas emitted from the channel radially outward into the gap.

14. The suppression device of claim 13, wherein the body includes a portion defined as a porous structure configured to permit gas to flow through.

15. The suppression device of claim 11, wherein the core further includes a plurality of locating rings with each corresponding to one of the plurality of suppression tubes to aid alignment of the core with the plurality of barrels.

16. The suppression device of claim 11, wherein the at least one of the plurality of suppression tubes includes a plurality of inner openings between its bore and the channel.

17. A suppression device for a rotary machine gun configured to direct propellant gas from each barrel of the rotary machine gun into a corresponding suppression tube to a longitudinal central channel of a core and through an exhaust opening of the suppression tubes into a gap between the core and a body and out though the suppression tubes and a porous structure of the body.

18. The suppression device of claim 17, wherein each of the suppression tubes includes an exhaust opening at a distal end to permit the propellant gas to exit the central channel.

19. The suppression device of claim 17, wherein the core includes a redirector at a distal end of the core that includes an angled surface to direct the propellant gas emitted from the central channel into the gap.

20. The suppression device of claim 17, wherein each of the suppression tubes includes a bore extending therethrough and an inner opening between the bore and the central channel to permit propellant gas to flow from the bore to the central channel.

* * * * *